US005556170A

United States Patent [19]

Lai et al.

[11] Patent Number: 5,556,170

[45] Date of Patent: Sep. 17, 1996

[54] SLEEVE STRUCTURE OF AN OFFICE CHAIR

[76] Inventors: Yu-Shan Lai, No. 5-1, Hou Tsuo Tzu; Kuan-Jen Lin, No. 784, I-Chiao St., both of Chia-I City, Taiwan

[21] Appl. No.: 517,967

[22] Filed: Aug. 22, 1995

[51] Int. Cl.[6] ..... A47C 15/00

[52] U.S. Cl. ..... 297/463.1; 297/344.19

[58] Field of Search ..... 297/344.19, 344.18, 297/344.12, 463.1, 463.2; 248/404, 157

[56] References Cited

U.S. PATENT DOCUMENTS

| | | | |
|---|---|---|---|
| 4,183,689 | 1/1980 | Wirges et al. | 248/404 X |
| 4,899,969 | 2/1990 | Bauer et al. | 297/344.19 X |
| 4,979,718 | 12/1990 | Bauer et al. | 297/344.19 X |
| 5,149,035 | 9/1992 | Bonnema et al. | 297/344.19 X |
| 5,413,414 | 5/1995 | Bauer | 297/344.18 X |
| 5,433,409 | 7/1995 | Knopp | 297/344.19 X |

*Primary Examiner*—Milton Nelson, Jr.
*Attorney, Agent, or Firm*—Browdy and Neimark

[57] ABSTRACT

A sleeve structure of an office chair fitted around a pneumatic bar. The sleeve structure includes a sleeve body and a steel circular tube. The sleeve body is a plastic hollow flexible member, having a sleeve hole and two annular stoppers at two ends. Multiple (preferably 8 to 12) equally spaced axial ribs are arranged on the outer surface of the sleeve body and three equally spaced axial slits are formed on the sleeve body. Two polygonal (preferably hexagonal, heptagonal or octagonal) plastic fitting members are fitted in two ends of the steel circular tube to form an assembly. Each fitting member has an annular stopper at an end thereof. The assembly of the steel circular tube and the fitting members is forcedly fitted into the sleeve hole of the sleeve body by a machine and locked by the stoppers of the sleeve body. In turn the pneumatic bar is fitted into the steel circular tube with the angles of the fitting members tightly contacting with the pneumatic bar nearly without clearance existing therebetween. Then the sleeve body is fitted into a bar seat tube to form a support stem of the office chair. When the pneumatic bar suffers a load or a torque by different inclined angles, the office chair is always stably and safely supported by the support stem without swinging to keep a user comfortable.

1 Claim, 4 Drawing Sheets

SLEEVE STRUCTURE OF AN OFFICE CHAIR

BACKGROUND OF THE INVENTION

The present invention relates to a sleeve structure of an office chair. The sleeve structure includes a sleeve body in which a pneumatic bar is fitted nearly without clearance existing therebetween. When the pneumatic bar suffers a load or a torque by different inclined angles, the office chair is always stably and safely supported without swinging.

Different types of office chairs (such as wooden chairs, iron chairs, sofa chairs, etc.) are widely used in various offices. Especially, the sofa office chairs are most popularly used in the offices. Each sofa office chair is supported by a support stem including a sleeve structure having a plastic flexible sleeve body in which a pneumatic bar is directly fitted. As shown in FIG. 4, the sleeve body with the pneumatic bar is fitted and fixed in a bar seat tube to form the support stem. Such sleeve structure has the following shortcomings:

1. The plastic flexible sleeve body is directly and not tightly fitted around the pneumatic bar. When the pneumatic bar suffers a load or a torque, the pneumatic bar will squeeze toward the sleeve body to deform the same and expand the sleeve hole thereof. As a result, a clearance will be produced between the sleeve body and the pneumatic bar and the office chair will tend to swing when loaded. This makes a user uncomfortable and unsafe when sitting on the office chair.

2. In the conventional sleeve structure of the office chair, the plastic flexible sleeve body is subject to permanent expansion and deformation after a long period of squeezing of the pneumatic bar. Therefore, the clearance between the pneumatic bar and the sleeve body will be more and more expanded. This makes the office chair unstably supported and liable to swing when suffering a heavy load. Moreover, when a user lies on the back of the office chair by a large inclined angle, the pneumatic bar and the sleeve body may be unable to bear the weight of the user and fall down.

SUMMARY OF THE INVENTION

It is therefore a primary object of the present invention to provide a sleeve structure of an office chair, which a sleeve body and a steel circular tube. The sleeve body is a plastic hollow flexible member, having a sleeve hole and two annular stoppers at two ends. Two polygonal (preferably hexagonal, heptagonal or octagonal) plastic fitting members are fitted in each of two ends of the steel circular tube to form an assembly. Each fitting member has an annular stopper at an end thereof. The assembly of the steel circular tube and the fitting members is forcedly fitted into the sleeve hole of the sleeve body by a machine and locked by the stoppers of the sleeve body. In turn the pneumatic bar is fitted into the steel circular tube with the fitting members tightly contacting with a pneumatic bar with nearly no clearance existing therebetween. When the pneumatic bar suffers a load or a torque by different inclined angles, the office chair is always stably and safely supported without swinging to keep a user comfortable and safe, It is a further object of the present invention to provide the above sleeve structure in which several equally spaced axial slits are formed on the sleeve body. The slits permit the sleeve body to be resiliently expanded so as to forcedly fit the assembly of the circular tube and the fitting members into the sleeve hole. In addition, the sleeve body can be resiliently deformed in accordance with the squeezing of the pneumatic bar by different inclined angles. The tightness between the pneumatic bar and the sleeve body is restored when a load on the pneumatic bar and sleeve body is removed. Therefore, the sleeve hole is not subject to expansion and permanent deformation after a long period of use and the office chair can be lastingly stably supported.

The present invention can be best understood through the following description and accompanying drawings, wherein:

DETAILED DESCRIPTION OF THE PREFERRED EMBODIMENT

Figure 1:
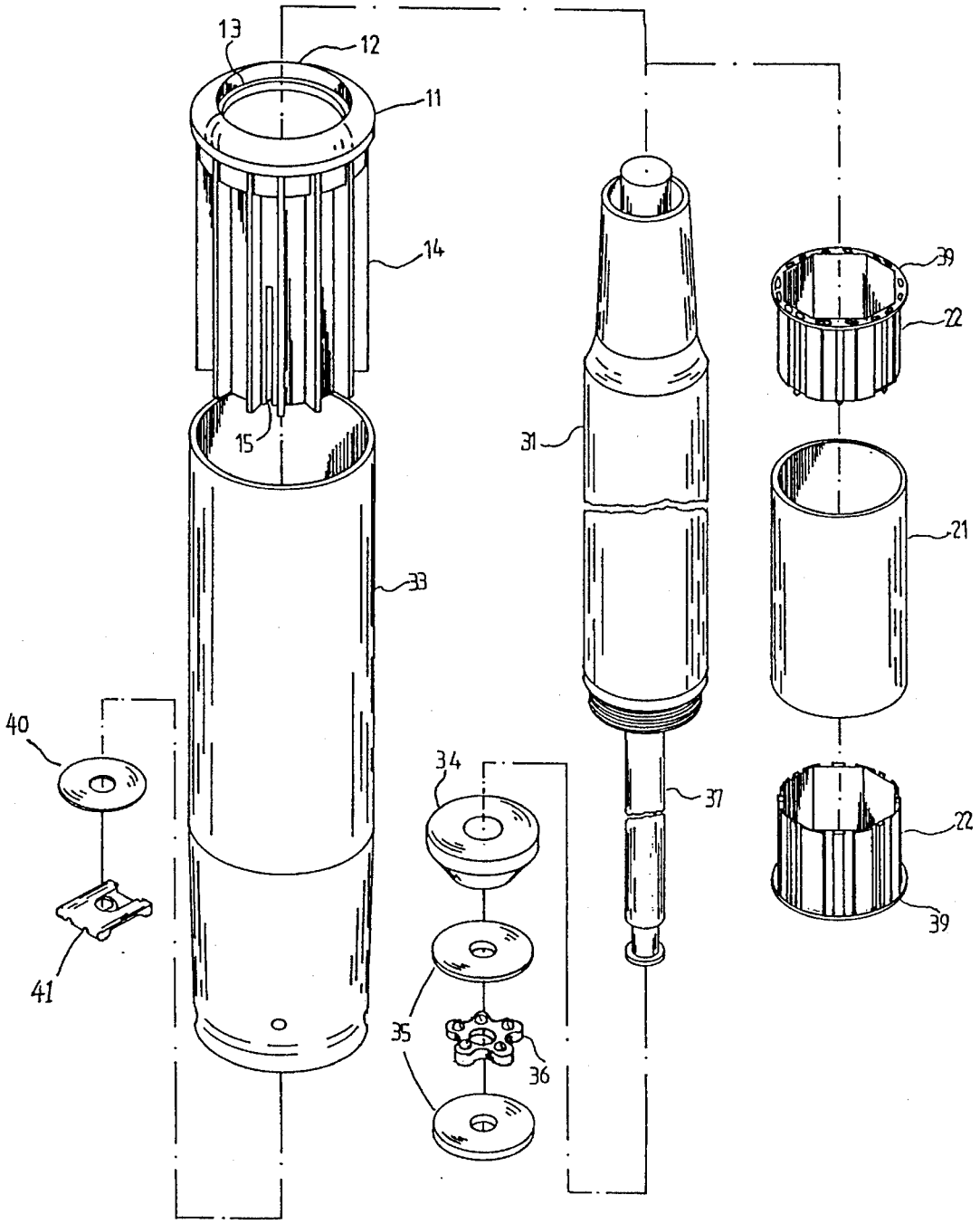
FIG. 1 is a perspective exploded view of the present invention.
Figure 2A:
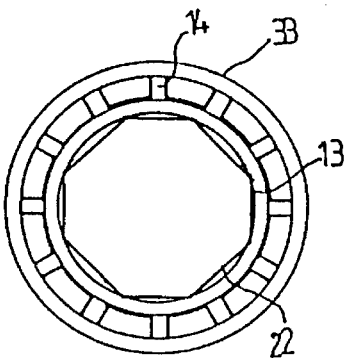
FIG. 2A is a sectional view taken along line A—A of FIG. 2.
Figure 2:
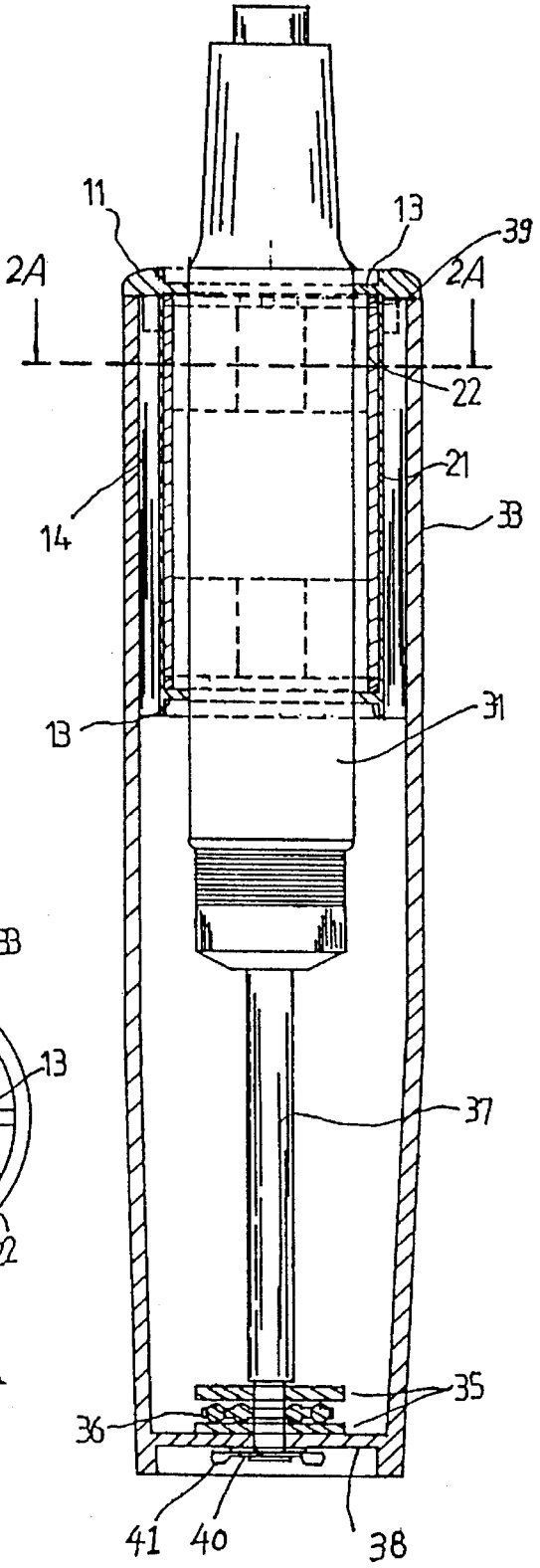
FIG. 2 is a sectional assembled view of the present invention.
Figure 3:
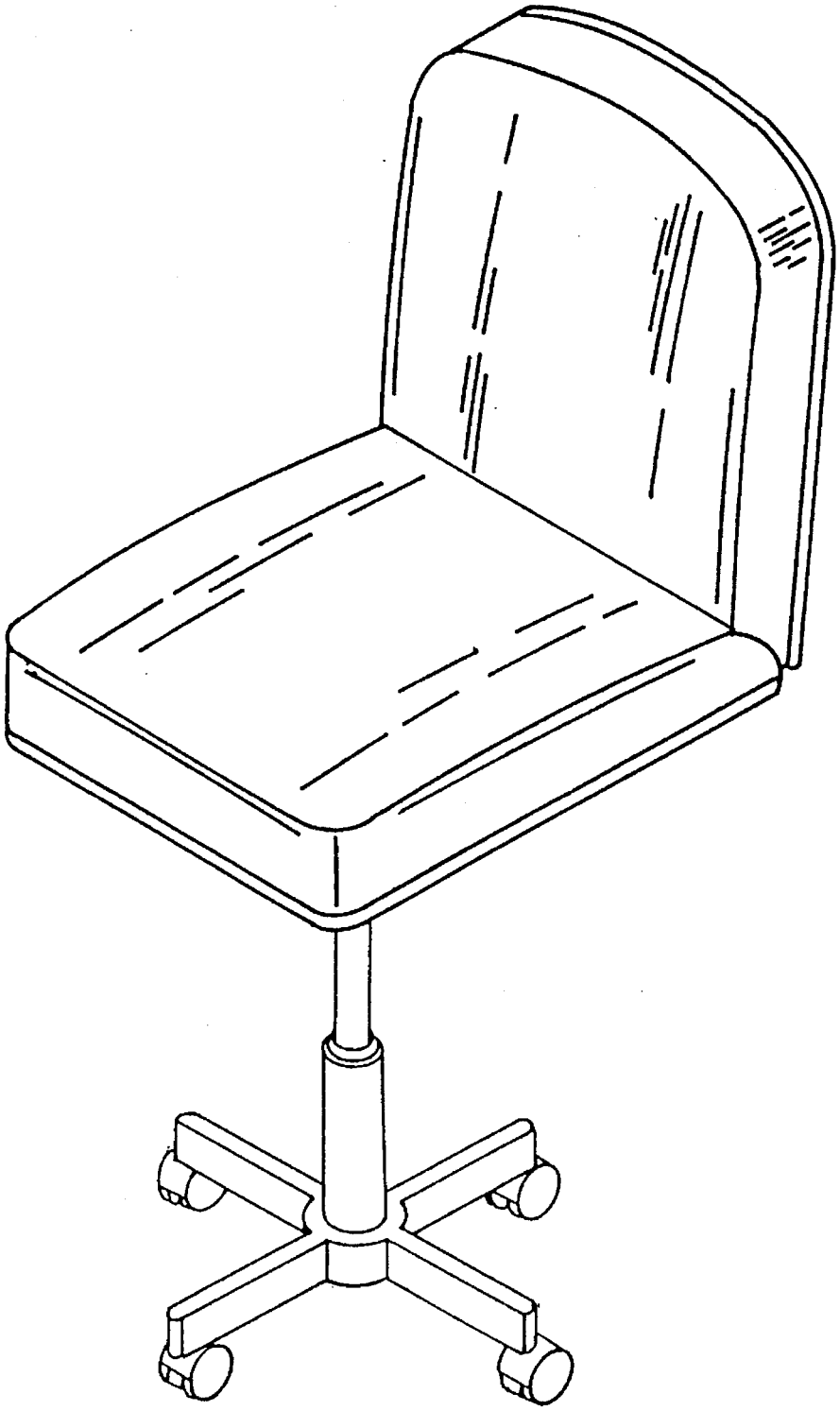
FIG. 3 shows that the office chair is supported by the sleeve structure of the present invention.
Figure 4:
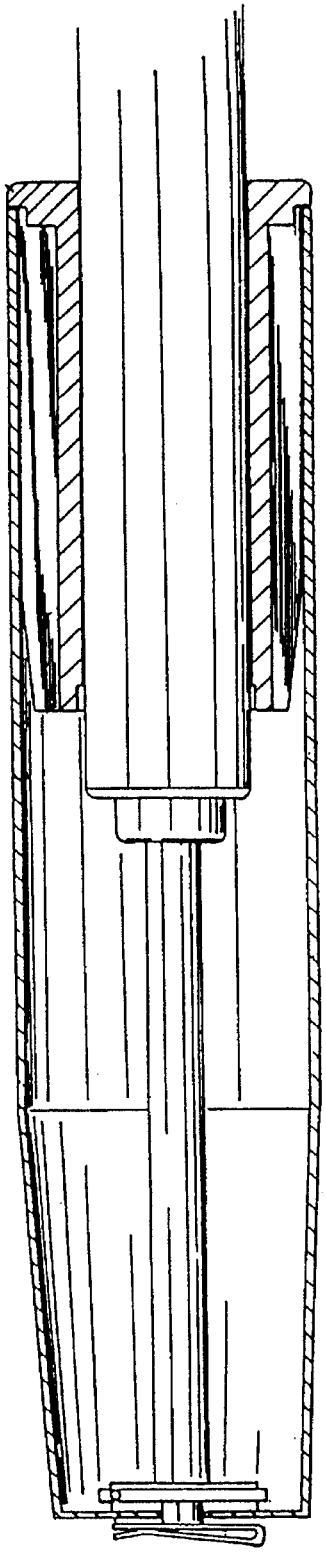
FIG. 4 (PRIOR ART)
FIG. 4 is a sectional view showing the conventional sleeve structure.

Please refer to FIG. 1. The sleeve structure of the present invention mainly includes a sleeve body 11, a steel circular tube 21, a pneumatic bar 31, a bar seat tube 33, a plastic pad 34, two washers 35, a plum blossom-shaped bearing plate 36 disposed with steel balls and an extensible rod 37.

The sleeve body 11 is a plastic hollow flexible member, having a sleeve hole 12 and two annular stoppers 13 at each of two ends. Multiple (preferably 8 to 12) equally spaced axial ribs 14 are arranged on the outer surface of the sleeve body 11 and three equally spaced axial slits 15 are formed on the sleeve body 11.

Two polygonal (preferably hexagonal, heptagonal or octagonal) plastic fitting members 22 are fitted in each of two ends of the steel circular tube 21 to form an assembly. Each fitting member 22 has an annular stopper 39 at an end thereof for separating the sleeve body 11 from the pneumatic bar 31.

The assembly of the steel circular tube 21 and the fitting members 22 is forcedly fitted into the sleeve hole 12 of the sleeve body 11 by a machine and locked by the stoppers 13 of the sleeve body 11. In turn the pneumatic bar 31 is fitted into the steel circular tube 21 nearly without clearance existing therebetween. Then the sleeve body 11 is fitted into the bar seat tube 33 with the extensible rod 37 fixedly connected with the bar seat tube 33 on annular flange 38 via the plastic pad 34, washers 35 and plum blossom-shaped bearing plate 36 above flange 38, and washer 40 and clip 41 below flange 38 to form a support stem of the office chair.

The sleeve structure of the present invention has the following advantages:

1. The assembly of the steel circular tube 21 and the fitting members 22 is forcedly fitted into the sleeve hole 12 of the sleeve body 11 by a machine and locked by the stoppers 13 of the sleeve body 11. In turn the pneumatic bar 31 is fitted into the steel circular tube 21 to tightly contact therewith. When the pneumatic bar 31 suffers a load by various inclined angles, the sleeve body 11 remains in tight contact with and supports the pneumatic bar 31 so as to keep the office chair used in a stable and safe condition.

2. The slits 15 formed on the sleeve body 11 permit the sleeve body 11 to be resiliently expanded so as to forcedly fit the assembly of the circular tube and the fitting members into the sleeve hole. In addition, the sleeve body 11 can be resiliently deformed in accordance with the squeezing of the pneumatic bar by different inclined angles. The tightness between the pneumatic bar and the sleeve body is restored after it is unloaded. Therefore, the sleeve hole is not subject to expansion and permanent deformation after a long period of use and the office chair can be lastingly stably supported. Therefore, a user can comfortably and safely sit on the office chair in any sitting attitude.

The above embodiment is only an example of the present invention and the scope of the present invention should not be limited to the example. Any modification or variation derived from the example should fall within the scope of the present invention.

What is claimed is:

1. A sleeve structure of an office chair, comprising a sleeve body, a steel circular tube, a pneumatic bar, a bar seat tube, a plastic pad, two washers, a plum blossom-shaped bearing plate disposed with steel balls and an extensible rod, said sleeve structure being characterized in that:

the sleeve body is a plastic hollow flexible member having a sleeve hole and an annular stopper at each of two ends thereof, multiple equally spaced axial ribs are arranged on the outer surface of the sleeve body and several equally spaced axial slits are formed on the sleeve body;

two polygonal plastic fitting members each respectively fitted in each of two ends of the steel circular tube to form an assembly, each fitting member of said two polygonal plastic fitting members having an annular stopper at an end thereof; and the assembly being forcedly fitted into the sleeve hole of the sleeve body by a machine and locked between the stopper at each of the two ends of the sleeve body.

* * * * *